US006769790B2

(12) United States Patent
Frühm et al.

(10) Patent No.: US 6,769,790 B2
(45) Date of Patent: Aug. 3, 2004

(54) THEATRICAL LIGHTING SYSTEM WITH MOVING LIGHTS

(76) Inventors: Hermann Frühm, 210-Tenth Avenue, New Westminster, British Columbia (CA), V3L 2B2; François Eugene Charron, 1202-1905 Robson Street, Vancouver, British Columbia (CA), V6G 1E6

( * ) Notice: Subject to any disclaimer, the term of this patent is extended or adjusted under 35 U.S.C. 154(b) by 21 days.

(21) Appl. No.: 09/835,189

(22) Filed: Apr. 12, 2001

(65) Prior Publication Data

US 2002/0149940 A1 Oct. 17, 2002

(51) Int. Cl.[7] ..... F21V 33/00

(52) U.S. Cl. ..... 362/286; 362/233; 362/287; 362/270

(58) Field of Search ..... 362/233, 85, 287, 362/270, 286, 396, 232, 238, 239, 250, 251, 252, 285, 418, 403

(56) References Cited

U.S. PATENT DOCUMENTS 4,025,777 A * 5/1977 Hayakawa ..... 240/1.4
5,398,177 A * 3/1995 Harwood ..... 362/270
6,022,129 A * 2/2000 Tang ..... 362/404
6,331,756 B1 * 12/2001 Belliveau ..... 315/316

* cited by examiner

*Primary Examiner*—Stephen Husar
*Assistant Examiner*—Anabel Ton
(74) *Attorney, Agent, or Firm*—Oyen Wiggs Green & Mutala

(57) ABSTRACT

A light is mounted on each one of a plurality of movable light supporting carts. The carts are moved along a predefined path. The lights can be energized to produce light beams as the carts move. Alternatively, the lights may remain off as the carts are controllably moved along the path to position each cart at a selected location along the path, and the lights energized after the carts are position. The carts, or selected carts, can be controllably moved at a selectably variable speed or speeds and/or in a selectably variable direction or directions while the lights are energized to produce the light beams. The lights themselves can be controllably moved with respect to their respective support carts, to controllably pan, tilt, swivel, etc. each light as the carts move, thereby facilitating production of a wide range of illumination effects.

17 Claims, 6 Drawing Sheets

THEATRICAL LIGHTING SYSTEM WITH MOVING LIGHTS

TECHNICAL FIELD

This invention provides a theatrical lighting system in which lights are movable during a performance to produce crowd-pleasing "light shows" and/or to controllably illuminate selected portions of a stage, theater, sports arena, etc.

BACKGROUND

Indoor or outdoor events such as rock concerts, sporting events, Olympic games, theme parks, worlds' fairs, theatrical performances, etc. often require illumination and may also include "light shows" in which a plurality of light sources are actuated for illumination purposes and/or to make a "visual statement" to entertain persons attending such events. Commonly for example, a variety of computer controlled laser light sources and/or strobe lights and/or search lights and/or theatrical lights produce sequences of moving and/or pulsating and/or variable color light beams and/or other lighting effects, often in synchronization with music and/or other sound effects.

It is also conventional to illuminate selected portions of a stage, arena, etc. by aiming one or more lights at such portions. This is typically accomplished by a skilled operator who manually actuates controls coupled to servo motors in order to energize (i.e. turn "on" so as to produce illumination), de-energize (i.e. turn "off"), aim, swivel, pan, tilt, etc. one or more lights, with additional controls being provided for varying the lights' brightness, applying color filters to the lights, etc.

Prior art lighting systems of the foregoing types utilize lights which typically remain fixed in position during the performance or event. That is, apart from servo-actuated aiming, swivelling, panning, tilting, etc. of individual lights, none of the lights are physically movable from one location to another location while the lights are operated to produce the light show, illuminate selected stage portions, etc.

The present invention provides a theatrical lighting system in which lights are movable between different physical locations while the lights are operated to create unique light show effects, illuminate selected stage portions, etc.

SUMMARY OF INVENTION

In accordance with the invention, a light is mounted on each one of a plurality of movable light supporting carts. The light-bearing carts are moved along a predefined path. The lights can be energized to produce light beams as the carts move. Alternatively, the lights may remain de-energized as the carts are controllably moved along the path to position each cart at a selected location along the path, and the lights energized after the carts are in position. The carts, or selected carts, can be controllably moved at a selectably variable speed or speeds and/or in a selectably variable direction or directions while the lights are energized to produce the light beams.

The lights themselves can be controllably moved with respect to their respective support carts, to controllably aim, pan, tilt, swivel, etc. each light as the carts move, thereby facilitating production of a wide range of illumination effects. If desired, the lights, or selected lights, can be controllably moved with respect to the carts to aim the lights at a selected focal point, and to maintain such aim if the focal point moves. The lights can also be individually controlled to selectably vary the color of the light beam produced by each light.

DESCRIPTION

Figure 1:
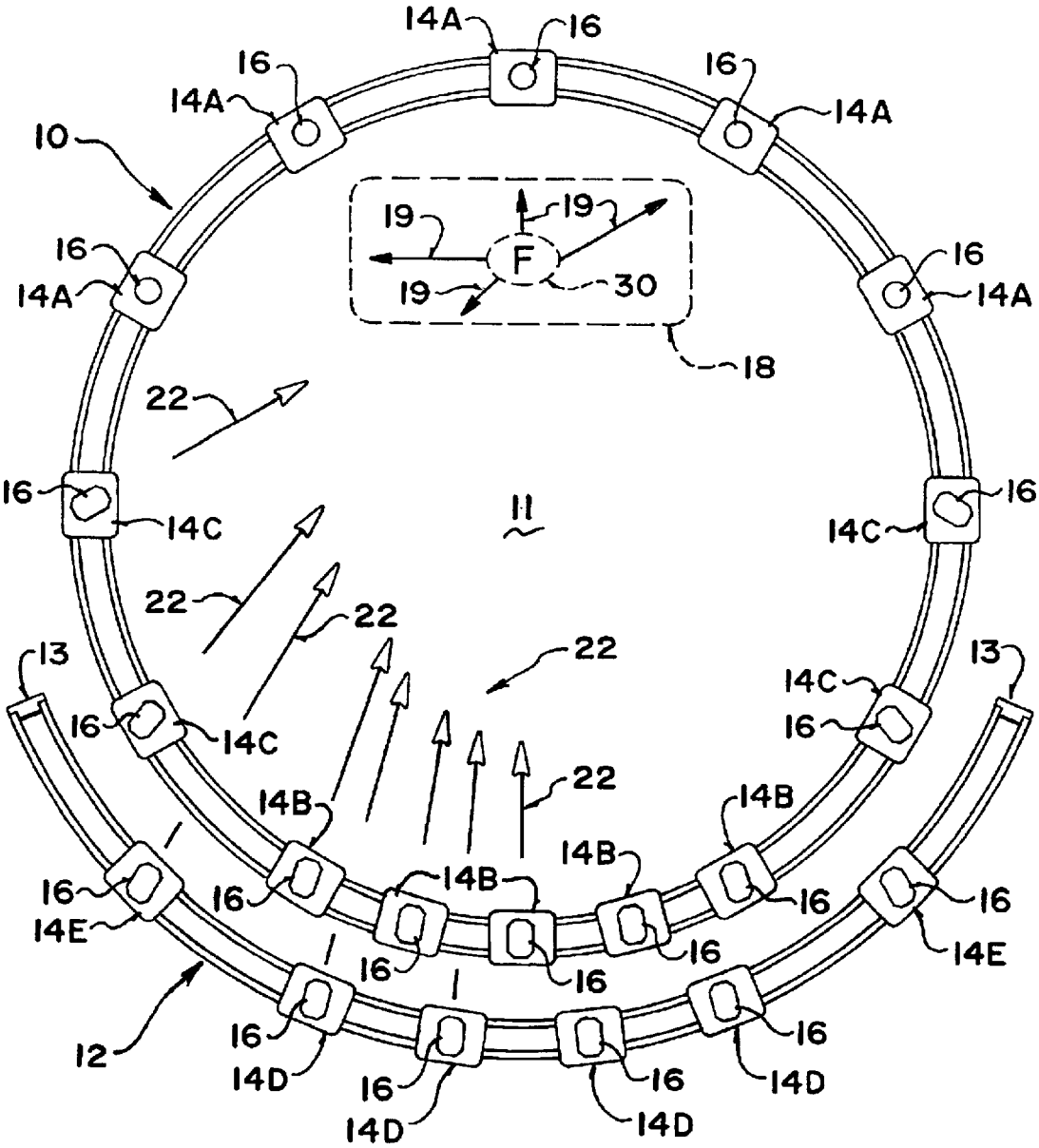
FIG. 1 is a top plan view of a theatrical lighting system in accordance with one embodiment of the invention.

FIG. 1 depicts two separate tracks 10, 12 along which lights are movable in accordance with the invention. Track 10 is configured to form a closed loop path enclosing region 11 which may fully or partially contain an audience and/or a "set" for an event, performance or for filming, etc. Track 10 happens to be circular in this embodiment, but could have any other desired path shape amenable to movement of lights, as hereinafter explained. Track 12 is in the form of an arc segment path having distinct end points with suitable end stops 13. Track 12 can have any desired path shape amenable to movement of lights as hereinafter explained.

A plurality of "movable light supports" such as wheeled carts 14A, 14B, 14C, 14D, 14E or other suitable vehicular mechanisms, are mounted on tracks 10, 12. One or more lights 16 are mounted on each cart. Lights 16 may for example be automated indoor/outdoor xenon search lights of the type manufactured by Space Canon vH of Fubine, Italy. Such lights incorporate computers and stepper motors which can be electrically coupled to suitable controllers to facilitate automated energizing (i.e. to produce illumination by turning the light "on"), de-energizing (i.e. turning "off"), aiming, panning, tilting, swivelling, dimming, beam convergence, beam divergence, etc. of the individual light.

Light-supporting carts 14A, 14B, 14C, 14D, 14E are moveable along tracks 10, 12 as hereinafter explained, with each of lights 16 being fully operational and controllable during such movement. For example, the five carts 14A shown on the upper half of track 10 as viewed in FIG. 1 have been moved to separate carts 14A at equal distances from one another along the upper half of track 10. By contrast, the five carts 14B shown on the lower half of track 10 as viewed in FIG. 1 have been moved to cluster carts 14B together in the lowermost part of track 10, with two carts 14C having been moved to space them farther apart and to the left of the 14B five-cart cluster; and, another two carts 14C having been moved to space them farther apart and to the right of the 14B five-cart cluster. Similarly, the central four carts 14D depicted on track 12 have been moved to cluster carts 14D together in the lowermost part of track 12 as viewed in FIG. 1, with the remaining two carts 14E positioned farther away on either side of carts 14D. Besides moving each light-bearing cart, one may also independently tilt, pan, swivel, rotate, etc. each of lights 16 by suitably actuating the aforementioned computers and stepper motors incorporated in each one of lights 16.

Figure 2:
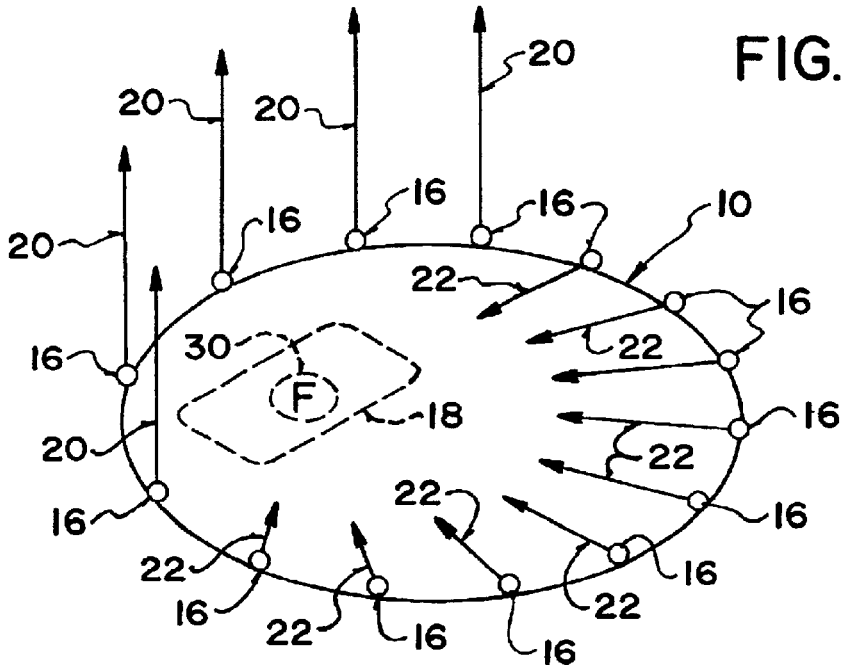
FIG. 2 is an oblique isometric schematic illustration of a portion of the FIG. 1 theatrical lighting system, showing the light beams projected when the lights are deployed as shown in FIG. 1.
Figure 3:
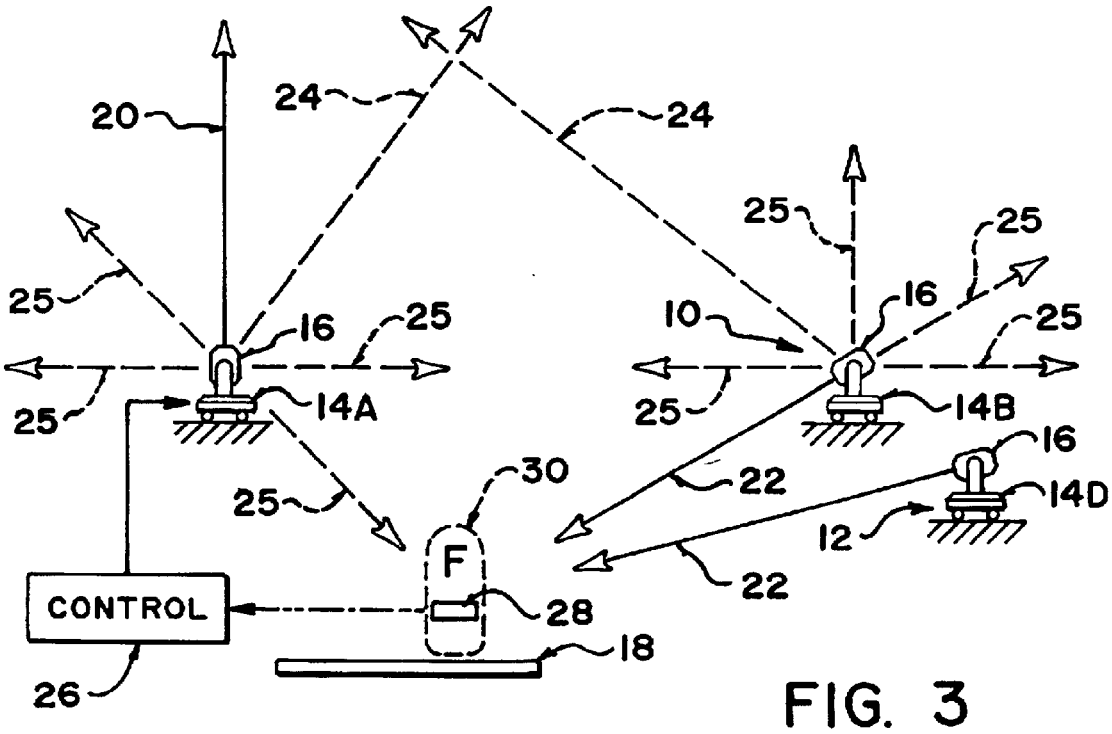
FIG. 3 is a partial side elevation sectional view of the FIG. 1 system.

FIGS. 2 and 3 depict an example of one of many different lighting arrangements which can be produced with the aid of the invention. For simplification, track 12 is not shown in FIG. 2, but it is shown in FIG. 3. FIG. 3 also illustrates the fact that track 10, track 12 and stage 18 may at different heights. For example, circular track 10 may be formed around the circumference of a stadium above the audience seating and playing/performance areas.

FIGS. 2 and 3 correspond to the situation in which carts 14A, 14B and 14C are positioned on track 10 as described above in relation to FIG. 1. More particularly, lights 16 on the five equally spaced carts 14A on the upper, central portion of track 10 (as viewed in FIG. 1) are actuated via their on-board computers and stepper motors to point each of those five lights at a steep upward angle to produce "backdrop" light rays 20 which may converge at a point above a notional focal point "F" on stage 18. Lights 16 on the remaining carts 14B, 14C on track 10 are energized to aim each of those lights at focal point F, producing stage illumination light rays 22 as shown in FIGS. 1, 2 and 3.

FIG. 3 depicts backdrop rays 20 and stage illumination rays 22 using solid lines. FIG. 3 also depicts, using dashed lines, additional converging light rays 24, and various other light rays 25, to illustrate the fact that each one of lights 16 can produce different light rays by suitably actuating their on-board computers and stepper motors to pan, tilt, swivel, etc. any one of lights 16 with respect to the cart on which that light is mounted. Some of the FIG. 3 light beams are represented by double-headed arrows which project in two axially opposed directions from one of lights 16. This can be achieved by mounting two lights back-to-back on a single cart, with provision being made for independently controlling each of the two lights.

Focal point F may be stationary or movable as indicated by arrows 19 in FIG. 1. A control system 26 (FIG. 3) can be provided to actuate the on-board computers and stepper motors on any selected ones of lights 16 to cause those lights to pan, tilt, swivel, change intensity, change color, etc. (whether or not the carts on which such lights are mounted are moving), to cause such lights to track focal point F, or to project light rays in any other desired manner. Tracking of focal point F can be accomplished, for example, by mounting a transponder 28 in a fixed location on stage 18. Alternatively, transponder 28 can be sewn into a garment or provided in a bracelet, pendant, necklace or other implement wearable by a performer 30. In either case, control system 26 monitors the location of transponder 28 in well known fashion by means of electronic signals exchanged via wireless communication between control system 26 and transponder 28.

In addition to controllably actuating the on-board computers and stepper motors on lights 16, control system 26 also controllably actuates carts 14A, 14B, 14C, 14D, 14E as hereinafter explained. Each cart can be moved backwards or forwards along tracks 10, 12 at a selected speed, under programmed and/or manual control by control system 26. Control system 26 maintains a database containing information representative of the current location of each cart and the current orientation of each one of lights 16 with respect to such light's cart, thus enabling control system 26 to produce signals to move selected carts and/or actuate the on-board computers and stepper motors on selected ones of lights 16 to keep those lights aimed at focal point F, or to project light rays in any other desired manner. Focal point F can move if transponder 28 is worn by a performer as aforesaid. A plurality of transponders can be provided at different locations on stage 18, or at other positions throughout the facility with which the theatrical lighting system is associated if control system 26 is suitably programmed to cause selected ones of lights 16 to track a selected one of the plurality of transponders.

As an alternative to transponder-based control of lights 16, a single "master" one of lights 16 can be aimed in conventional fashion by an operator using a joystick or other suitable device coupled to the master light's on-board computer and stepper motor, with any selected ones of the remaining lights 16 being "slaved" to the master light such that the master and all of the slave lights are simultaneously panned, tilted, swivelled, etc. as the operator actuates the joystick control device.

FIGS. 4A–4D schematically depict different arrangements of moveable lights in accordance with the invention. White circles "○" represent lights 16 which are "on". Black circles "●" represent lights 16 which are "off" (i.e. not energized to produce illumination; lights 16 can be moved whether they are on or off). For simplification, the carts which support each light 16 are not shown in FIGS. 4A–4D.

Figure 4A:
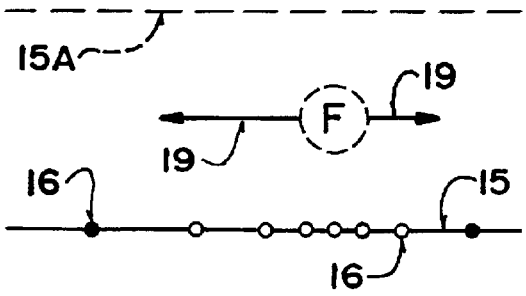
FIGS. 4A, 4B, 4C and 4D respectively schematically depict different arrangements of moveable lights in accordance with the invention.

FIG. 4A depicts an embodiment of the invention incorporating two straight, parallel tracks 15, 15A. For simplification, track 15A is represented only schematically as a dashed line. A single transponder or otherwise-defined focal point F which can move as indicated by arrows 19 is shown. The FIG. 4A embodiment is, for example, representative of a movable lighting arrangement for a football field, track, or other area which can be illuminated by means of spaced apart, straight parallel tracks along which carts bearing lights 16 can be moved. Lights 16 can be moved along tracks 15, 15A to group or cluster the lights to illuminate focal point F, as is indicated in FIG. 4A by the clustered white circles "○" representing lights which are "on".

Figure 4B:
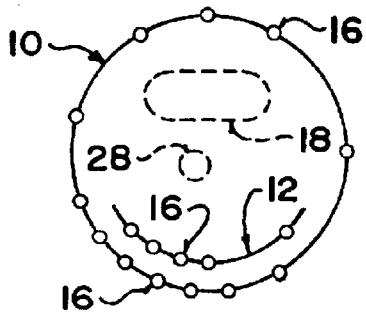

FIG. 4B corresponds to FIGS. 1, 2 and 3 except that FIG. 4B shows track 12 inside track 10. The dashed outline bearing reference numeral 18 indicates that a conventional fixed "stage" is unnecessary: the invention facilitates movement and aiming of lights 16 such that any portion of the facility associated with the theatrical lighting system may be illuminated to serve as a stage. The dashed outline bearing reference numeral 28 reflects the fact that one or more transponders may be associated with stage 18 and/or associated with (i.e. worn by) one or more performers, who need not necessarily remain on the "stage". That is, transponders 28 need not necessarily result in illumination of stage 18, but may be positioned to illuminate any desired feature or object in the facility associated with the theatrical lighting system.

Figure 4C:
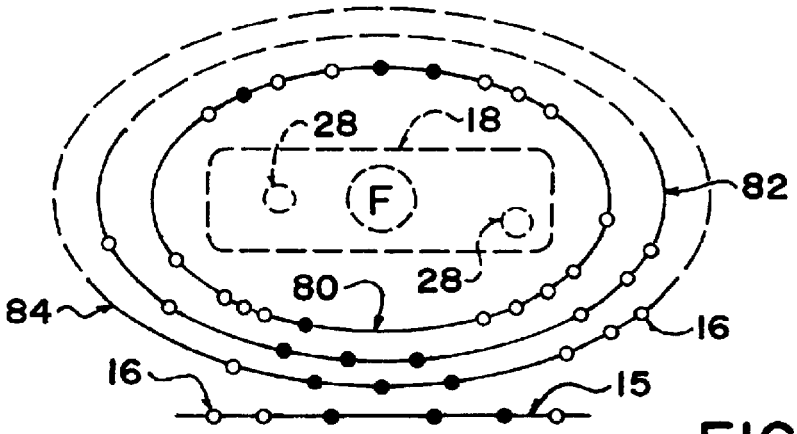

FIG. 4C depicts another embodiment of the invention incorporating a closed oval track 80 within two additional tracks 82, 84. The dashed outline portions of tracks 82, 84 indicate that those tracks may be either closed loops or arc segments, as desired. An additional linear track 15 is also depicted in FIG. 4C. Light-bearing carts can be mounted on and moved along each of tracks 80–86 as previously explained. The dashed outlines bearing reference numeral 28 illustrate the fact that each transponder may be associated with different lights. For example, in FIG. 4C, some lights 16 have been moved to cluster them together on the lower right portions of tracks 80, 82, 84 to better enable those lights to be focused upon and illuminate the right hand transponder 28; whereas other lights 16 have been moved to cluster them together on the lower left portions of tracks 80, 82, 84 to better enable those lights to be focused upon and illuminate the left hand transponder 28.

Figure 4D:
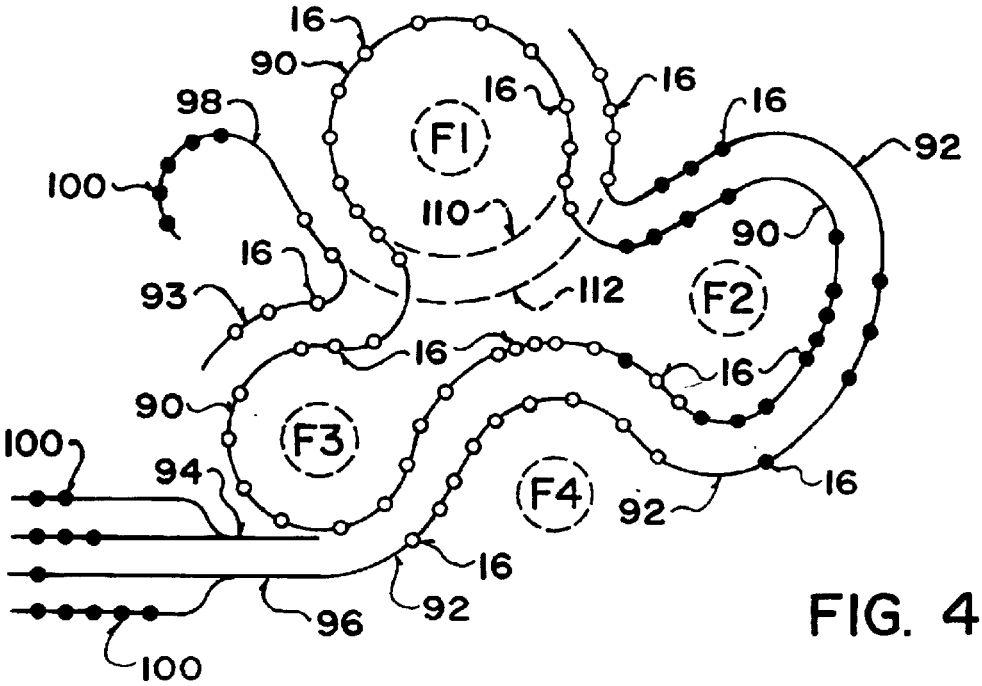

FIG. 4D depicts another embodiment of the invention incorporating an irregular shaped, closed path track 90; and two irregular shaped, open-ended tracks 92, 93 along either of which light-bearing carts can be moved to associate lights 16 with any one or more of performance focal areas F1, F2, F3 or F4. Shunt tracks 94, 96, 98 are provided for storage of unused lights 100. More particularly, shunt track 94 is coupled to track 90 to enable lights to be moved off track 90 onto shunt track 94 for storage, repair, etc.; and/or to enable additional lights to be moved off shunt track 94 and into service on track 90. Shunt track 96 is couplable to track 92 to enable lights to be moved off track 92 onto shunt track 96 for storage, repair, etc.; and/or to enable additional lights to be moved off shunt track 96 and into service on track 92. Shunt track 98 is coupled to track 93 and further couplable to track 92 as indicated by dashed line track segment 112 to enable lights to be moved off either of tracks 92, 93 onto shunt track 98 for storage, repair, etc.; and/or to enable additional lights to be moved off shunt track 98 and into service on either of tracks 92, 93. Dashed line track segments 110, 112 can be included to provide a closed loop track analogous to tracks 10, 12 described above with reference to FIGS. 1, 2 and 3.

Figure 5A:
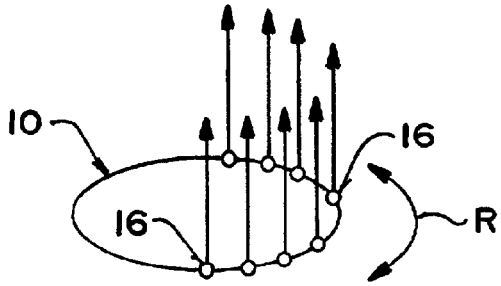
FIGS. 5A–5N respectively schematically depict different light show effects and stage illumination effects producible by theatrical lighting systems in accordance with the invention.
Figure 5B:
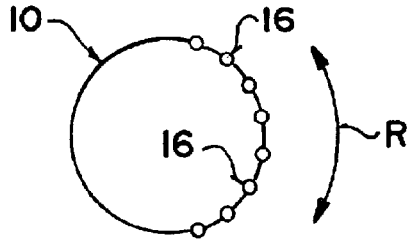
Figure 5C:
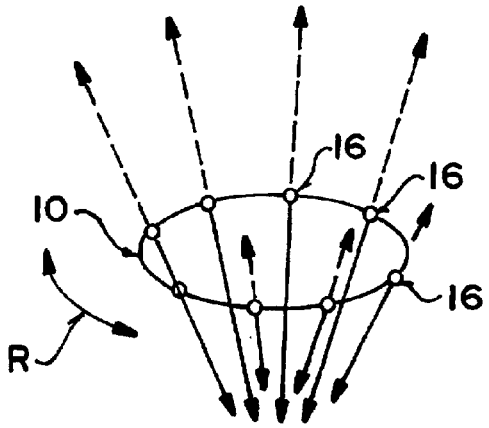
Figure 5D:
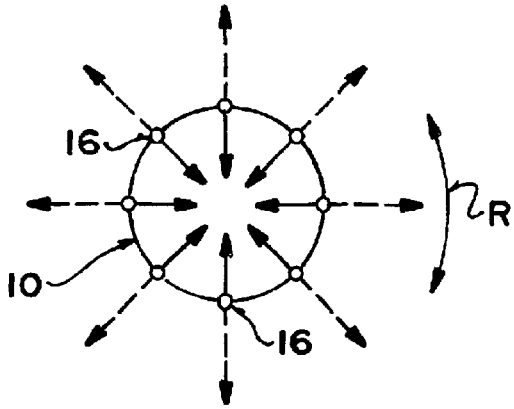
Figure 5E:
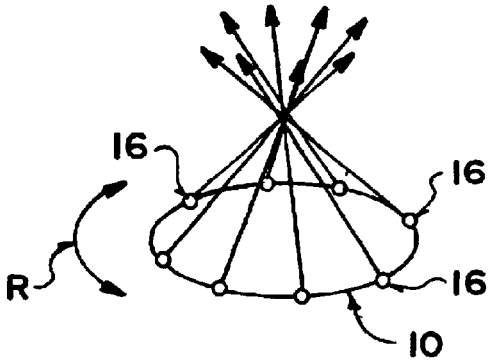
Figure 5F:
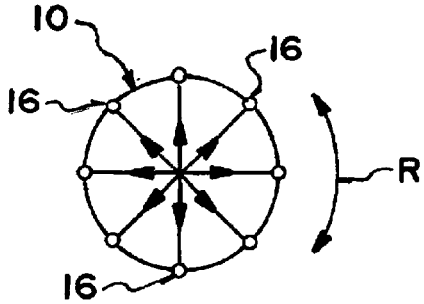
Figure 5G:
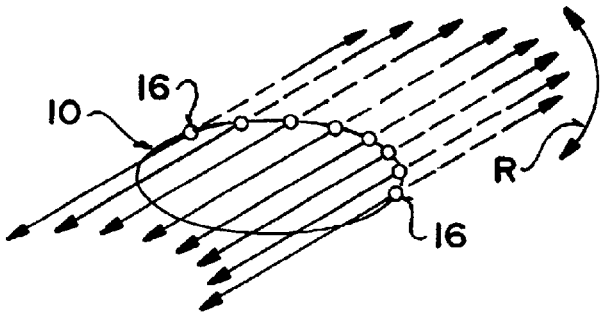
Figure 5H:
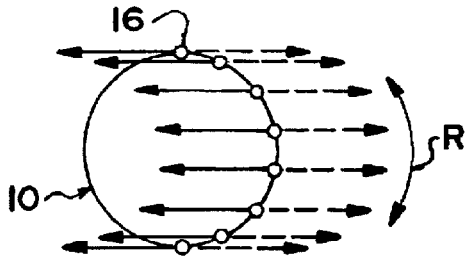
Figure 5I:
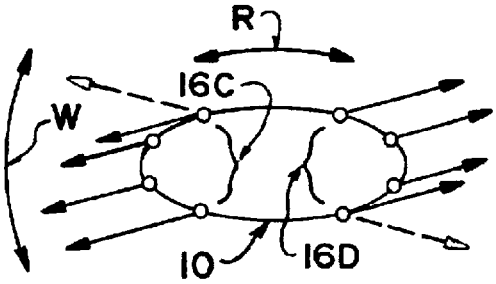
Figure 5J:
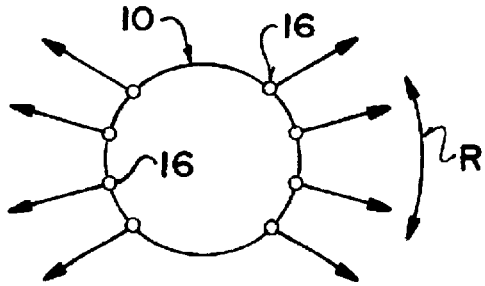
Figure 5K:
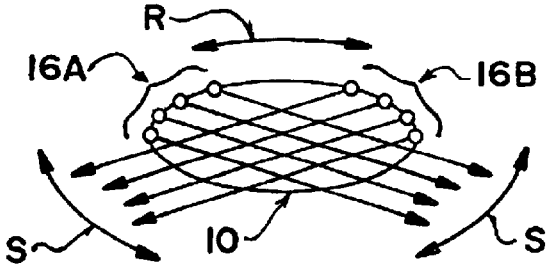
Figure 5L:
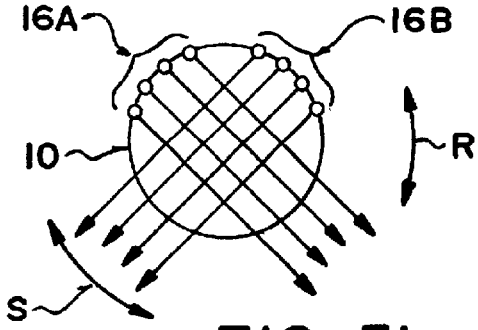
Figure 5M:
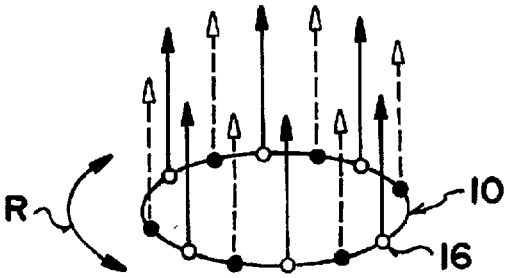
Figure 5N:
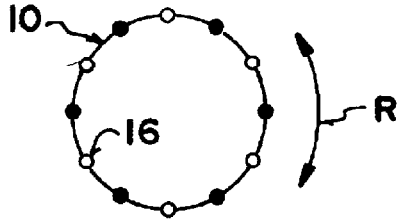

FIGS. 5A–5N schematically depict different light show effects and/or stage illumination effects producible by theatrical lighting systems in accordance with the invention. White circles "○" represent lights 16 which are "on". Black circles "●" represent lights 16 which are "off". For simplification, the carts which support each light 16 are not shown in FIGS. 5A–5N.

FIGS. 5A, 5B are respectively oblique top and top plan views showing a plurality of parallel, vertical light beams (represented by the vertical arrows in FIG. 4A) produced by clustering together on track 10 a plurality of carts bearing lights 16 and actuating the lights' on-board computers and stepper motors to aim each light vertically. Arcuate, double-headed arrow R indicates that the carts can be caused to move in either direction along track 10 while the lights are energized to produce a moving light beam lighting effect.

FIGS. 5C, 5D are respectively oblique bottom and top plan views showing a "funnel" lighting effect producible by equidistantly spacing on track 10 a plurality of carts bearing lights 16 and actuating the on-board computers and stepper motors on each of lights 16 to tilt each light such that the resultant light beams project radially outwardly and away from one another and at an angle relative to a notional plane containing track 10. The light beams are represented by straight, double-headed arrows in FIGS. 6C, 6D indicating usage of double-headed lights which project light in two axially opposed directions. Specifically, each arrow has a solid line portion to indicate light beam projection beneath the notional plane containing track 10, and a dashed line portion to indicate light beam projection above the notional plane containing track 10. Arcuate, double-headed arrow R again indicates that the carts can be caused to move in either direction along track 10 while the lights are energized to produce a moving funnel lighting effect.

FIGS. 5E, 5F are respectively oblique top and top plan views showing a "conical" lighting effect producible by equidistantly spacing on track 10 a plurality of carts bearing single-headed lights 16 and actuating the lights' on-board computers and stepper motors to aim each light inwardly and upwardly at the same angle relative to the notional plane containing track 10. This produces a plurality of light beams (represented by straight arrows) which intersect at an apex point above the notional plane containing track 10. The conical lighting effect can be enhanced by further actuating the lights' on-board computers and stepper motors to vary the displacement between the apex point and the notional plane containing track 10. If desired, an inverted conical lighting effect (not shown) can be produced by actuating the lights' onboard computers and stepper motors to aim the lights at an apex point below the notional plane containing track 10. A moving, diverging/converging conical lighting effect can be produced by actuating the lights' on-board computers and stepper motors to continuously sweep the apex point through a range of positions above and below the notional plane containing track 10. Arcuate, double-headed arrow R again indicates that the carts can be caused to move in either direction along track 10 while the lights are energized and actuated to produce a variety of moving conical lighting effects.

FIGS. 5G, 5H are respectively oblique bottom and top plan views showing a "searchlight" lighting effect producible by equidistantly spacing on track 10 a plurality of carts bearing lights 16 and actuating the lights' on-board computers and stepper motors to aim each light in the same direction, such that the projected light beams remain parallel to one another. The light beams are represented by straight, double-headed arrows in FIG. 5G indicating usage of double-headed lights which project light in two axially opposed directions. Specifically, each arrow has a solid line portion to indicate light beam projection beneath the notional plane containing track 10, and a dashed line portion to indicate light beam projection above the notional plane containing track 10. The lighting effect can be enhanced by further actuating the lights' on-board computers and stepper motors to tilt, swivel, rotate, etc. each light while maintaining the light beams parallel to one another. Arcuate, double-headed arrow R again indicates that the carts can be caused to move in either direction along track 10 while the lights are energized and actuated to produce a variety of moving searchlight lighting effects. Alternatively, instead of maintaining the light beams parallel to one another, one could actuate the lights' on-board computers and stepper motors to aim each light at a selected azimuth and elevation relative to the immediately adjacent and preceding light, such that when viewed from a selected direction, the projected light beams appear to radiate from a common origin with fixed angular spacing between adjacent light beams (not shown).

FIGS. 5I, 5J are respectively oblique top and top plan views showing a "nodding" lighting effect producible by clustering two separate groups 16C, 16D of lights on opposite sides of track 10, and actuating the lights' on-board computers and stepper motors to produce light beams (represented by straight arrows in FIGS. 5I and 5J) which project radially outwardly and away from track 10. The lighting effect can be enhanced by further actuating the lights' on-board computers and stepper motors to alternately sweep the light beams in unison (or sequentially) upwardly and downwardly as indicated by double-headed arrow W; or, to alternately sweep each 1st, 3rd, etc. light upwardly while simultaneously sweeping each 2nd, 4th, etc. light downwardly, etc. Arcuate, double-headed arrow R again indicates that the carts can be caused to move in either direction along track 10 while the lights are energized and actuated to produce a variety of moving nodding lighting effects.

FIGS. 5K, 5L are respectively oblique top and top plan views showing a "cross over" lighting effect producible by clustering two separate groups 16A, 16B of lights on opposite sides of track 10, and actuating the lights' on-board computers and stepper motors to produce light beams (represented by straight arrows in FIGS. 5K and 5L) which are parallel to one another and parallel to or at any selected angle relative to the notional plane containing track 10.

Arcuate, double-headed arrows "S" indicate that the lights' on-board computers and stepper motors can be actuated to sweep each group of light beams through any desired arc, while maintaining each group of light beams parallel to one another. Arcuate, double-headed arrow R again indicates that the carts can be caused to move in either direction along track 10 while the lights are energized and actuated to produce a moving, sweeping cross over lighting effect.

FIGS. 5M, 5N are respectively oblique top and top plan views showing a "pulsating" lighting effect whereby every other light along track 10 is alternately, momentarily switched on and off. The black circles "●" on track 10 in FIGS. 5M, 5N represent lights which are momentarily "off", and the white circles "○" represent lights which are momentarily "on". The solid line vertical arrows in FIG. 5M represent light beams projected by lights which are "on", and the dashed arrows represent light beams which are momentarily "off". Arcuate, double-headed arrow R again indicates that the carts can be caused to move in either direction along track 10 while the lights are energized and actuated to produce a moving, pulsating lighting effect as the light beams are momentarily switched on and off as aforesaid. Any selected combination of lights can be pulsated on and off as aforesaid; and, such pulsation may be combined with any other lighting effect producible in accordance with the invention.

Figure 6:
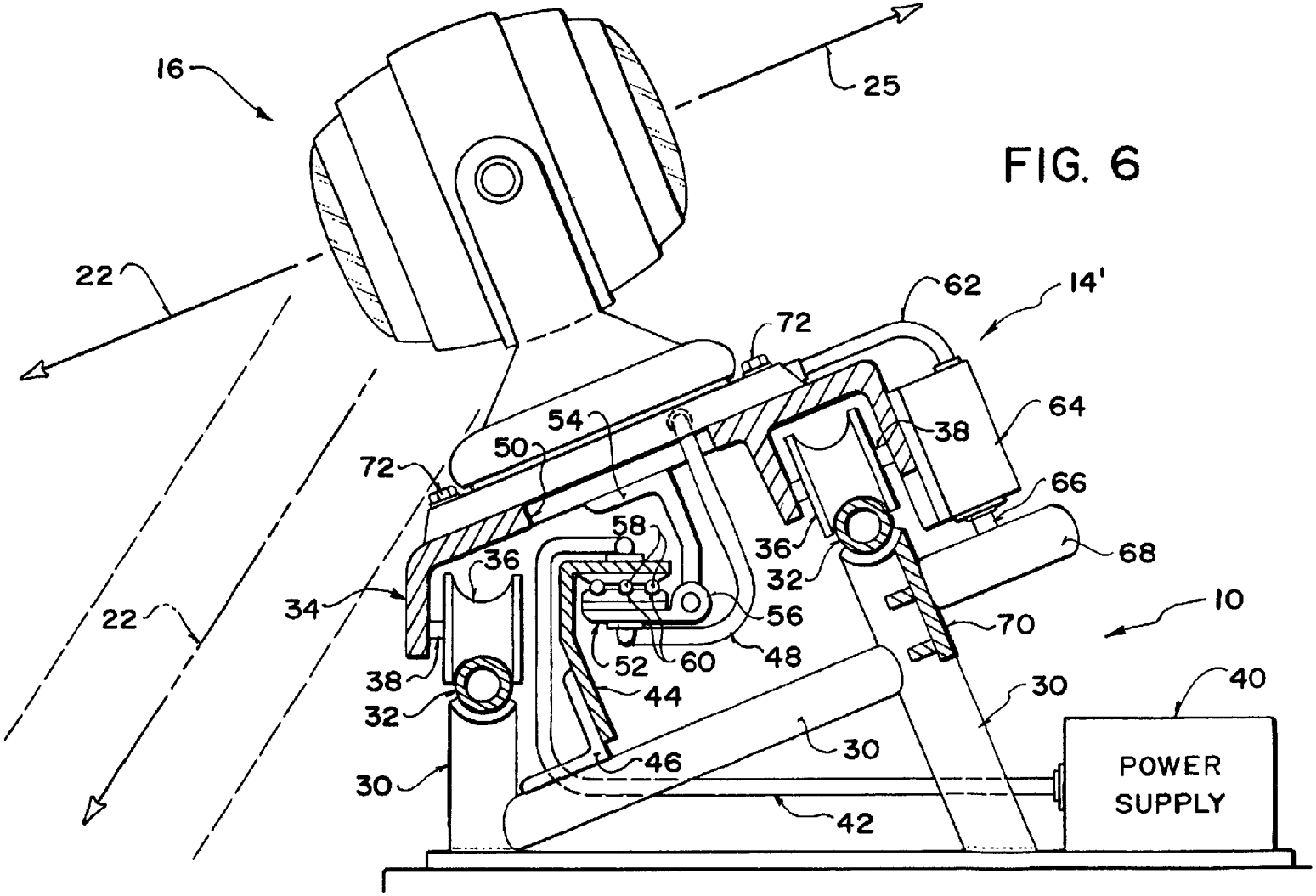
FIG. 6 is a partially sectioned side elevation view of one embodiment of a track and self-propelled cart for moving lights in accordance with the invention.

FIG. 6 shows how cart 14' with light 16 mounted thereon can be positioned for movement along track 10. Track 10 comprises structural members 30 which are welded together to form a rigid framework supporting rails 32. If desired, the framework can be configured to elevate one of rails 32 with respect to the other rail, for example to counteract centrifugal forces generated as cart 14' moves along track 10 (in the case of a circular or other arcuate track shape). Cart 14' incorporates a platform 34 on which light 16 is fixedly mounted. Wheels 36 are rotatably supported on axles 38 which are in turn fixed on opposed undersides of cart 14' in suitable positions for rotatable engagement of wheels 36 with tracks 32.

A power supply 40 is provided at any suitable location alongside track 10. Power conductor 42 is electrically coupled between power supply 40 and power rail 44, which extends the full length of track 10 between and parallel to rails 32. Power rail 44 is supported by brackets 46 which are in turn fastened to support members 30. Cart power conductor 48 protrudes downwardly through aperture 50 in cart platform 34 and is electrically coupled between light 16 and wiper 52. Bracket 54 fixed to the underside of platform 34 extends beneath platform 34 and between wheels 36. Wiper 52 is pivotally coupled to the lower end of bracket 54 via spring-loaded swivel mount 56 which biases wiper 52 upwardly against the underside of power rail 44 to maintain continuous electrical contact between power conductors 58 on power rail 44 and slidably mating power contacts 60 provided on wiper 52.

Another power conductor 62 is electrically coupled between conductor 48 and a "drive mechanism" such as drive motor 64 which is fixed to the side of platform 34. The drive shaft 66 of motor 64 is drivingly coupled to wheel 68 which rotates against a traction surface 70 provided on one of members 30 and extending the entire length of track 10. In addition to providing power for operation of light 16 and drive motor 64, the above-described power coupling mechanism can also be used to electrically couple control signals between control system 26 (FIG. 3) and light 16's on-board computer and stepper motor.

As will be apparent to those skilled in the art in the light of the foregoing disclosure, many alterations and modifications are possible in the practice of this invention without departing from the spirit or scope thereof. For example, instead of configuring motor 64 (FIG. 6) to drivingly rotate wheel 68 against traction surface 70, one could alternatively couple drive motor 64 to either or both of axles 38 to directly drive wheels 36 along rails 32. As another example, rails 32 and wheels 36 could have geared surfaces to facilitate more precise positioning of carts 14' with respect to tracks 10, 12. As a further example, any of lights 16 may be equipped with dual 180° opposed light emitting modules capable of emitting two longitudinally opposed light rays, as previously explained with reference to FIG. 3. As another example, brakes (not shown) can be coupled to wheels 36 for controllable actuation by control system 26 in order to stop any selected cart 14' at a particular point on tracks 10, 12. Such brakes can be configured to remain actuated in the absence of applied electrical power as a safety feature to prevent unintended movement of carts 14' in the event of a power failure. Accordingly, the scope of the invention is to be construed in accordance with the substance defined by the following claims.

What is claimed is:

1. A lighting method, comprising:

(a) providing a plurality of lights, each one of said lights for producing a light beam;

(b) providing a plurality of movable light supports;

(c) mounting each one of said lights on a corresponding one of said supports;

(d) defining a path to be traversed by said supports and said lights;

(e) controllably moving each one of said supports and said lights along said path at a selectably variable speed, independently of movement of any other one of said supports and said lights along said path, and while energizing said lights to produce said light beams; and (f) controllably moving said lights with respect to said supports.

2. A lighting method, comprising:

(a) providing a plurality of lights, each one of said lights for producing a light beam;

(b) providing a plurality of movable light supports;

(c) mounting each one of said lights on a corresponding one of said supports;

(d) defining a path to be traversed by said supports and said lights;

(e) controllably moving each one of said supports and said lights along said path at a selectably variable speed, independently of movement of any other one of said supports and said lights along said path, and while energizing said lights to produce said light beams; and (f) controllably moving said lights with respect to said supports to aim said lights at a selected focal point.

3. A lighting method, comprising:

(a) providing a plurality of lights, each one of said lights for producing a light (b) providing a plurality of movable light supports;

(c) mounting each one of said lights on a corresponding one of said supports;

(d) defining a path to be traversed by said supports and said lights;

(e) controllably moving each one of said supports and said lights along said path at a selectably variable speed, independently of movement of any other one of said supports and said lights along said path, and while energizing said lights to produce said light beams; and (f) controllably moving said lights with respect to said supports to keep said lights aimed at a moving focal point.

4. A lighting method, comprising:

(a) providing a plurality of lights, each one of said lights for producing a light beam;

(b) providing a plurality of movable light supports;

(c) mounting each one of said lights on a corresponding one of said supports;

(d) defining a path to be traversed by said supports and said lights;

(e) controllably moving each one of said supports and said lights along said path at a selectably variable speed, independently of movement of any other one at said supports and said lights along said path, and while energizing said lights to produce said light beams; and (f) selectably varying the color of said light beams.

5. Lighting apparatus, comprising:

(a) a plurality of movable light supports;

(b) a light beam producing light mounted on each one of said supports;

(c) a track traversable by said supports and said lights;

(d) a power supply couplable to each one of said lights to energize said respective lights; and, (e) a drive mechanism for driving each one of said supports and said lights along said track, independently of driving of any other one of said supports and said lights along said path.

6. Lighting apparatus as defined in claim 5, wherein said lights are further mounted on said respective supports for controllable movement of said lights with respect to said respective supports.

7. Lighting apparatus as defined in claim 5, wherein said drive mechanism further comprises a drive motor on each one of said supports.

8. Lighting apparatus as defined in claim 7, wherein said drive motors are variable speed motors.

9. Lighting apparatus as defined in claim 7, wherein said drive motors are variable speed and reversible motors.

10. Lighting apparatus as defined in claim 5, further comprising a controllable brake mounted on each one of said respective supports.

11. Lighting apparatus as defined in claim 5, further comprising a controller coupled to said power supply and to said drive mechanism for controllably moving said supports and said lights along said track and for controllably actuating said lights to produce said light beams.

12. Lighting apparatus as defined in claim 6, further comprising a controller coupled to said drive mechanism and to said respective lights for controllably moving said supports and said lights along said track and for controllably actuating and moving said lights to produce said light beams.

13. A lighting method, as defined in any one of claim 1, 2, 3 or 4, wherein said controllably moving each one of said supports further comprises positioning each one of said supports at a selected location along said path.

14. A lighting method, as defined in any one of claim 1, 2, 3 or 4, wherein said controllably moving each one of said supports and said lights further comprises moving said supports and said lights along said path in a selectably variable direction.

15. A lighting method, as defined in any one of claim 1, 2, 3 or 4, wherein said controllably moving each one of said supports and said lights further comprises moving selected ones of said supports and said lights along said path.

16. A lighting method, as defined in any one of claim 1, 2, 3 or 4, wherein said controllably moving each one of said supports and said lights further comprises moving selected ones of said supports and said lights along said path in a selectably variable direction.

17. A lighting method, as defined in any one of claim 1, 2, 3 or 4, wherein said controllably moving each one of said supports further comprises controllably maintaining a selected distance between adjacent ones of said supports.

* * * * *